US011848509B2

(12) United States Patent
Chang et al.

(10) Patent No.: US 11,848,509 B2
(45) Date of Patent: Dec. 19, 2023

(54) ELECTRICAL CONNECTOR

(71) Applicant: LOTES CO., LTD, Keelung (TW)

(72) Inventors: Wen Chang Chang, Keelung (TW); Nan Zhou, Keelung (TW)

(73) Assignee: LOTES CO., LTD, Keelung (TW)

( * ) Notice: Subject to any disclaimer, the term of this patent is extended or adjusted under 35 U.S.C. 154(b) by 270 days.

(21) Appl. No.: 17/526,068

(22) Filed: Nov. 15, 2021

(65) Prior Publication Data

US 2022/0399663 A1 Dec. 15, 2022

(30) Foreign Application Priority Data

Jun. 10, 2021 (CN) ..... 202121293060.9

(51) Int. Cl.
*H01R 12/67* (2011.01)
*H01R 12/71* (2011.01)
*H01R 13/6471* (2011.01)

(52) U.S. Cl.
CPC ..... *H01R 12/675* (2013.01); *H01R 12/71* (2013.01); *H01R 13/6471* (2013.01)

(58) Field of Classification Search
CPC ..... H01R 12/675; H01R 12/67; H01R 12/65; H01R 12/59; H01R 12/50; H01R 12/71; H01R 12/712; H01R 12/714; H01R 13/646; H01R 13/6461; H01R 13/6471
USPC ..... 439/66–68
See application file for complete search history.

(56) References Cited

U.S. PATENT DOCUMENTS

| | | | | |
|---|---|---|---|---|
| 11,264,765 | B2 * | 3/2022 | Ho | H01R 13/2407 |
| 2019/0372274 | A1 * | 12/2019 | Feng | H01R 13/46 |
| 2022/0399663 | A1 * | 12/2022 | Chang | H01R 12/71 |

FOREIGN PATENT DOCUMENTS

| | | | |
|---|---|---|---|
| CN | 205178171 | U | 4/2016 |
| CN | 103972730 | B | 10/2017 |
| CN | 109742606 | B | 12/2020 |
| CN | 112134095 | A | 12/2020 |
| TW | I596840 | B | 8/2017 |

* cited by examiner

*Primary Examiner* — Khiem M Nguyen
(74) *Attorney, Agent, or Firm* — Locke Lord LLP; Tim Tingkang Xia, Esq.

(57) ABSTRACT

An electrical connector includes an insulating body having a mating slot and multiple accommodating slots are in communication with the mating slot. Multiple terminals are accommodated in the accommodating slots. The terminals include ground terminals. Each terminal includes a connecting portion, an elastic arm, a tail portion, and an extending portion located between the connecting portion and the tail portion. The extending portion of each terminal extends obliquely downward and backward from the connecting portion. A grounding member is provided on the insulating body. The grounding member has a multiple upper and lower extending arms. A length of each upper extending arm is shorter than a length of each lower extending arm in the front-rear direction. The upper and lower extending arms respectively abut the ground terminals, thus shortening the transmission paths of the terminals. The grounding member and the ground terminals are in stable connection, thus reducing the resonance.

13 Claims, 14 Drawing Sheets

221
22
21
21
26
26
2
26
26
321
321
24
24
331
331
23
2S
2G
2S
2G
2S
2G

B-B

C-C

3

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN202121293060.9 filed in China on Jun. 10, 2021. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and particularly to an electrical connector which shortens the transmission path thereof and is suited for transmitting high frequency signals.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An existing electrical connector includes an insulating body, a plurality of conductive terminals and a grounding member. The insulating body has a mating slot used to be inserted by the mating member. The conductive terminals are provided at an upper side and a lower side of the mating slot in two rows. The conductive terminals in the upper row include a plurality of signal terminals and a plurality of ground terminals. Each conductive terminal has a contact portion, a soldering portion, and a connecting portion connecting the contact portion and the soldering portion. The contact portion protrudes into the mating slot to be electrically connected to the mating member. The soldering portion extends downward out of the insulating body to be soldered to a circuit board.

The electrical connector may be based on the mounting requirements to mount the electrical connector on the circuit board, such that the mating slot and the circuit board are provided to be substantially parallel. The electrical connector is connected to the mating member and the circuit board being provided in parallel. Thus, the connecting portion includes a horizontal section extending substantially horizontal and a vertical section vertically connected between the horizontal section and the soldering portion. The grounding member elastically abuts the vertical section of each ground terminal in the upper row to reduce the resonance. Since the connecting portion of each conductive terminal in the upper row is formed by the horizontal section extending substantially horizontal and the vertical section vertically connected between the horizontal section and the soldering portion, such structure of each conductive terminal in the upper row makes the transmission path thereof long and has a serious resonance. Further, the grounding member elastically abuts the vertical section at a single point, which may be ill or unreliable, thus affecting the high frequency characteristics of the electrical connector.

Therefore, a heretofore unaddressed need to design a new electrical connector exists in the art to address the aforementioned deficiencies and inadequacies.

SUMMARY

In view of the deficiency of the background, the present invention is directed to an electrical connector, which shortens the conductive paths of the conductive terminals in the upper row, and allows the grounding member to form stable contact in multiple points with the ground terminals of the conductive terminals in the upper row, thus being suited for transmitting high-frequency signals.

To achieve the foregoing objective, the present invention adopts the following technical solutions.

An electrical connector is configured to be electrically connected to a mating member and a circuit board. The electrical connector includes: an insulating body, having a mating slot and a plurality of accommodating slots, wherein the mating slot is concavely formed backward from a front end surface of the insulating body to be inserted by the mating member, the accommodating slots are arranged in an upper row and a lower row and provided at an upper side and a lower side of the mating slot, respectively, and the accommodating slots are in communication with the mating slot; a plurality of conductive terminals arranged in an upper row and a lower row, correspondingly accommodated in the accommodating slots in the upper row and the lower row, wherein the conductive terminals in the upper row comprise two ground terminals and at least one signal terminal located between the two ground terminals, each of the conductive terminals comprises a connecting portion, an elastic arm formed by extending from the connecting portion, a tail portion exposed from the insulating body and an extending portion located between the connecting portion and the tail portion, the connecting portion is accommodated in a corresponding one of the accommodating slots, the elastic arm has a contact portion protruding into the mating slot to be in contact with the mating member and to form an electrical connection therebetween, the tail portion is configured to be connected to the circuit board, the extending portion of each of the conductive terminals in the upper row extends obliquely downward and backward from the connecting portion, and the extending portion of each of the conductive terminals in the upper row is located behind the extending portion of each of the conductive terminals in the lower row; and a grounding member, fixedly provided on the insulating body, wherein the grounding member has a base portion and two upper extending arms and two lower extending arms formed by extending backward from the base portion, the base portion is located between the extending portions of the conductive terminals in the upper row and the lower row, the upper extending arms are located above the lower extending arms, a length of each of the upper extending arms extending in a front-rear direction is shorter than a length of each of the lower extending arms extending in the front-rear direction, the two upper extending arms abut the two ground terminals of the conductive terminals in the upper row, the two lower extending arms abut the two ground terminals of the conductive terminals in the upper row, and one of the two upper extending arms and one of the two lower extending arms abut a same ground terminal of the two ground terminals of the conductive terminals in the upper row.

In certain embodiments, each of the conductive terminals in the upper row has a fixing portion formed by extending forward from a front side edge of the extending portion, the insulating body is provided with a plurality of retaining slots, each of the retaining slots corresponds to the fixing portion of each of the conductive terminals in the upper row, each of the retaining slots is formed by being concavely provided forward on a rear end surface of the insulating body, the fixing portion of each of the conductive terminals in the upper row is fixed to a corresponding one of the retaining slots, and each of the upper extending arms and each of the lower extending arms all abut the extending portion between the fixing portion and the tail portion of the same ground terminal.

In certain embodiments, the rear end surface of the insulating body is provided with a plurality of narrow slots, each of the narrow slots is correspondingly in upward communication with one of the accommodating slots in the upper row and correspondingly accommodates the extending portion of one of the conductive terminals in the upper row, each of the retaining slots is in communication with one of the narrow slots in the front-rear direction, the insulating body is provided with a partition bar between each two adjacent ones of the narrow slots, each of the conductive terminals in the upper row is provided with a plurality of strip connecting portions located at a rear side of the extending portion, and one of the strip connecting portions and the fixing portion are provided to be back on each other.

In certain embodiments, a length of the extending portion located between the connecting portion and the fixing portion is greater than a length of the extending portion located between the fixing portion and the tail portion.

In certain embodiments, the insulating body is provided with a groove formed by recessing forward on the rear end surface of the insulating body, and the groove is located below the retaining slots to accommodate the base portion.

In certain embodiments, the groove is further formed with at least one mounting hole concavely provided forward, the base portion is provided with a first through hole corresponding to each of the at least one mounting hole, the first through hole is in forward communication with a corresponding one of the at least one mounting hole, the first through hole is provided for a jig to fix the grounding member, such that the grounding member is fixed to the insulating body, and the mounting hole is reserved for the jig.

In certain embodiments, the insulating body has at least one protruding post formed by extending backward from a slot wall of the groove, the base portion is provided with a second through hole corresponding to each of the at least one protruding post, and the protruding post passes backward through and is accommodated by the corresponding second through hole to position the grounding member.

In certain embodiments, the insulating body is provided with a groove formed by recessing forward on a rear end surface of the insulating body, the grounding member is accommodated in the groove, the insulating body is provided with a plurality of partition ribs in the groove and provided in an upper row and a lower row, a receiving slot is formed between two adjacent ones of the partition ribs in each of the upper row and the lower row, each of the upper extending arms is correspondingly accommodated in the receiving slot located in the upper row, and each of the lower extending arms is correspondingly accommodated in the receiving slot located in the lower row.

In certain embodiments, each of at least some of the receiving slots in each of the upper row and the lower row is further forward concavely provided with a fixing hole, the grounding member has at least one upper fixing portion and at least one lower fixing portion formed by extending forward from the base portion, and the upper fixing portion and the lower fixing portion are respectively fixed to the corresponding fixing holes, such that the grounding member is fixed to the insulating body.

In certain embodiments, the extending portion of each of the conductive terminals in the lower row is vertically provided.

In certain embodiments, the conductive terminals in the upper row are formed by blanking a metal plate, each of the upper extending arms is provided with a pair of upper clamping arms, each of the lower extending arms is provided with a pair of lower clamping arms, the pair of upper clamping arms and the pair of lower clamping arms clamp a left side and a right side of the corresponding extending portion.

In certain embodiments, each of the conductive terminals in the upper row further comprises at least one strip connecting portion provided at a rear side of the extending portion, the strip connecting portion is configured to be connected to a strip, and the strip connecting portion forms a vertical breaking edge extending straightly along a vertical direction at a side away from the corresponding extending portion.

In certain embodiments, the grounding member has at least one upper fixing portion and at least one lower fixing portion formed by extending forward from the base portion, the upper fixing portion and the lower fixing portion are respectively fixed to the insulating body, the conductive terminals in the upper row comprise more than two ground terminals and a plurality of signal terminals, two of the signal terminals are provided between each two adjacent ones of the ground terminals, the grounding member is provided with more than two upper extending arms and more than two lower extending arms, the base portion is further provided with a plurality of connecting sheets respectively located between each two adjacent ones of the upper extending arms and between each two adjacent ones of the lower extending arms, each of the connecting sheets is in a vertical flat plate shaped structure, each of the connecting sheets located at an upper side of the base portion is selectively connected to one of the upper fixing portions, and each of the connecting sheets located at an lower side of the base portion is selectively connected to one of the lower fixing portions.

Compared with the related art, the electrical connector according to certain embodiments of the present invention has the following beneficial effects.

Without changing the positions of the contact portion and the tail portion, the extending portion of each conductive terminal in the upper row may be provided to extend obliquely downward and backward from the connecting portion. Such configuration shortens the transmission paths of the conductive terminals in the upper row, and particularly reduces the loss in the transmission paths of the signal terminals and reduces the inductance of the signal terminals. The upper extending arms and the lower extending arms of the grounding member all abut the ground terminals of the conductive terminals in the upper row, and the length of each upper extending arm is shorter than the length of each lower extending arm. Thus, the grounding member may facilitate multiple point contact with a same ground terminal, thus ensuring the stable connection between the grounding member and the ground terminals, and effectively reducing the resonance.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
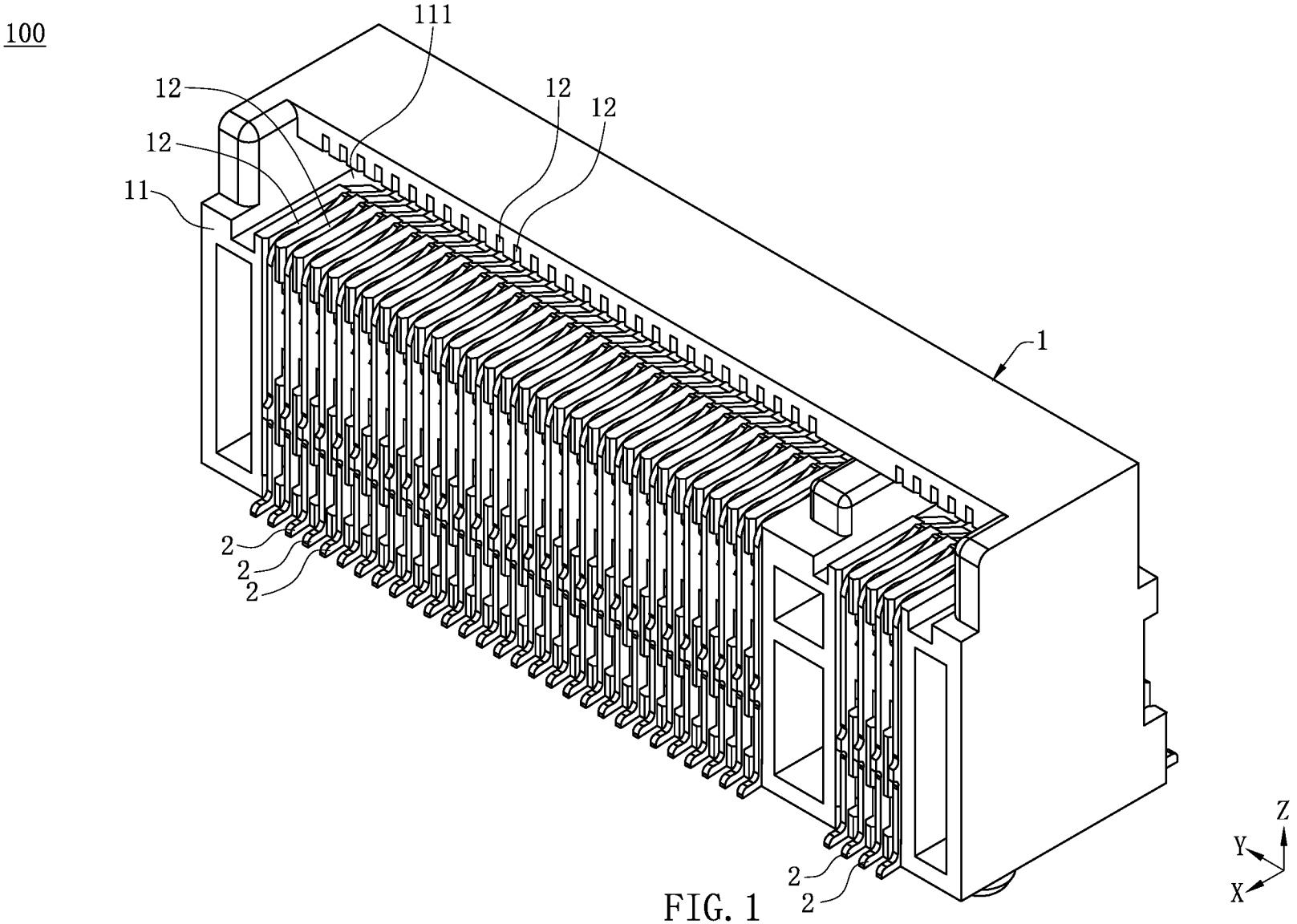
FIG. 1 is a perspective view of an electrical connector according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-14. In accordance with the purposes of this invention, as embodied and broadly described herein, this invention, in one aspect, relates to an electrical connector.

Figure 12:
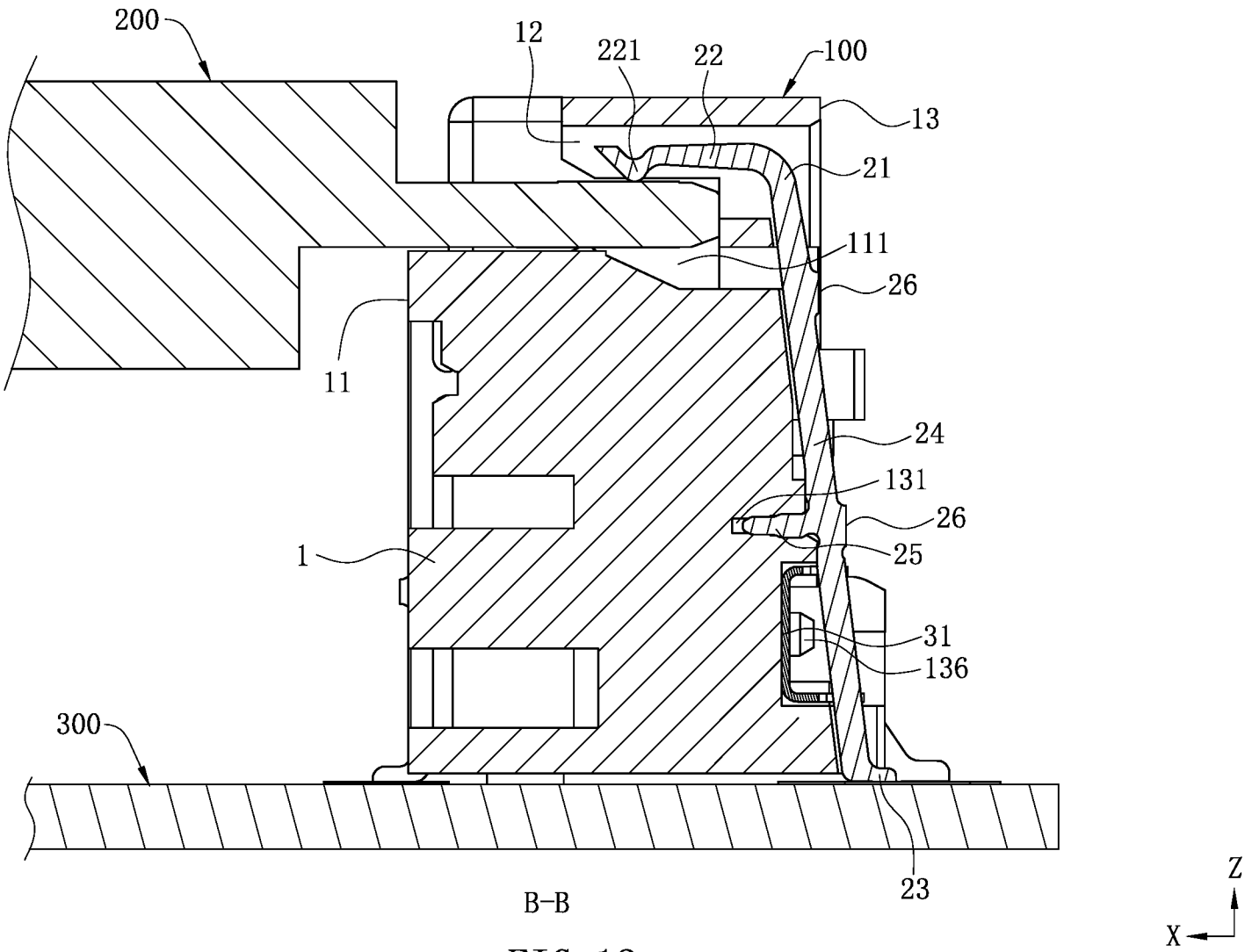
FIG. 12 is a sectional view of FIG. 11 sectioned along a line B-B and mated with the mating member and the circuit board.
Figure 13:
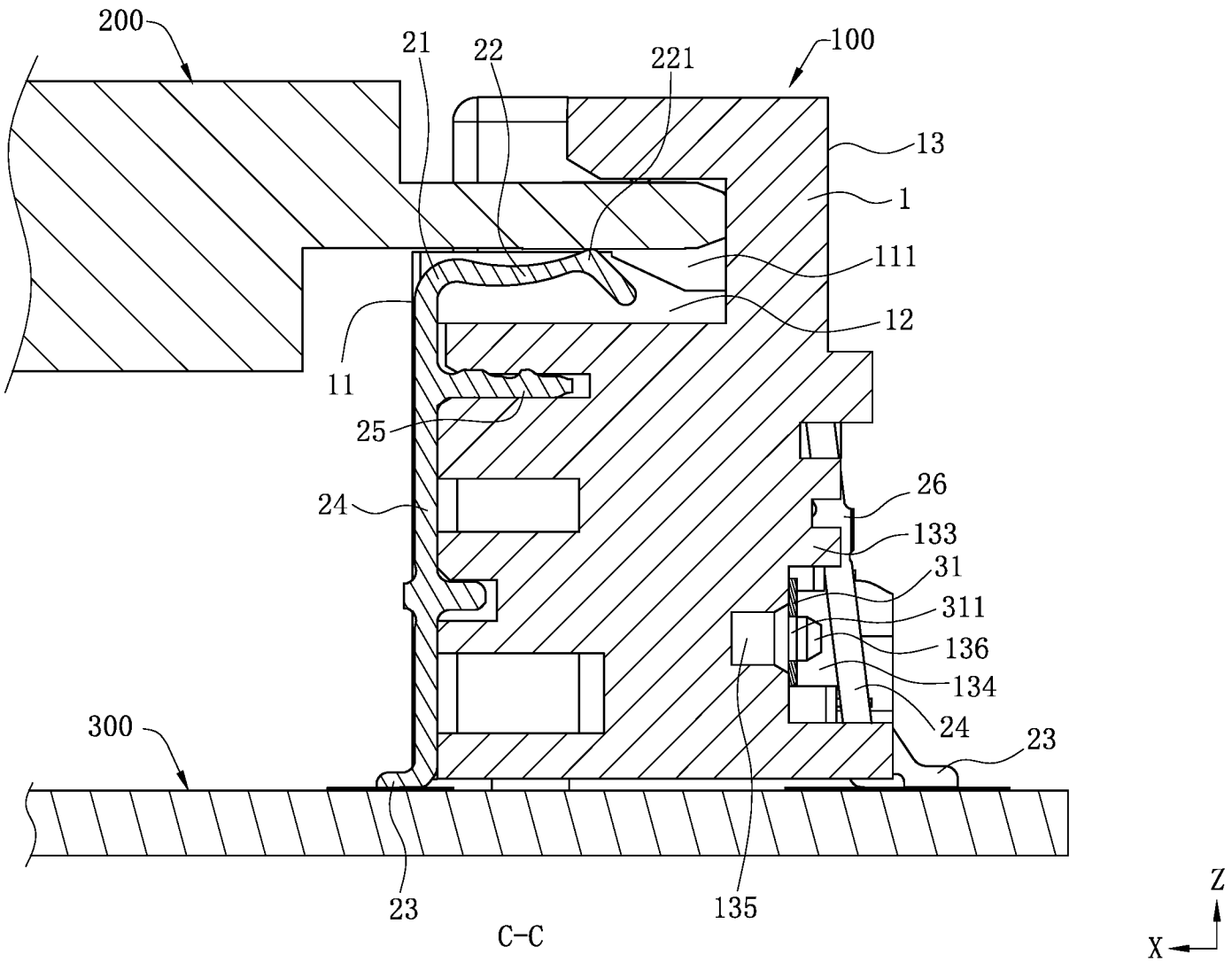
FIG. 13 is a sectional view of FIG. 11 sectioned along a line C-C and mated with the mating member and the circuit board.

FIG. 1, FIG. 12 and FIG. 13 show an electrical connector 100 according to certain embodiments of the present invention. The electrical connector 100 is used to electrically connect a mating member 200 and a circuit board 300. The mating member 200 may be an electronic card, and the mating member 200 is inserted to the electrical connector 100 backward from a front thereof. The electrical connector 100 is mounted downward to the circuit board 300. The structural description of the electrical connector 100 is described with an embodiment using the Next Generation Form Factor (NGFF, also known as M.2) as a transmission interface.

For convenience in describing the specific structures of the electrical connector 100, a forward direction in a front-rear direction is defined as a positive direction of an X-axis, a rightward direction in a left-right direction is defined as a positive direction of a Y-axis, an upward direction in a vertical direction is defined as a positive direction of a Z-axis, and the front-rear direction, the left-right direction and the vertical direction are perpendicular to one another.

As shown in FIG. 1, FIG. 12 and FIG. 13, the electrical connector 100 includes an insulating body 1, a plurality of conductive terminals 2 accommodated in the insulating body 1, and a grounding member 3 retained in the insulating body 1.

As shown in FIG. 1, FIG. 12 and FIG. 13, the insulating body 1 has a front end surface 11 located at a front side of the insulating body 1 in the front-rear direction. The insulating body 1 has a mating slot 111 concavely formed backward from the front end surface 11, and the mating slot 111 is used to be inserted by the mating member 200. The insulating body 1 has a plurality of accommodating slots 12. The accommodating slots 12 are arranged in an upper row and a lower row and provided at an upper side and a lower side of the mating slot 111. The accommodating slots 12 are in communication with the mating slot 111. The insulating body 1 further has a rear end surface 13 provided opposite to the front end surface 11.

Figure 2:
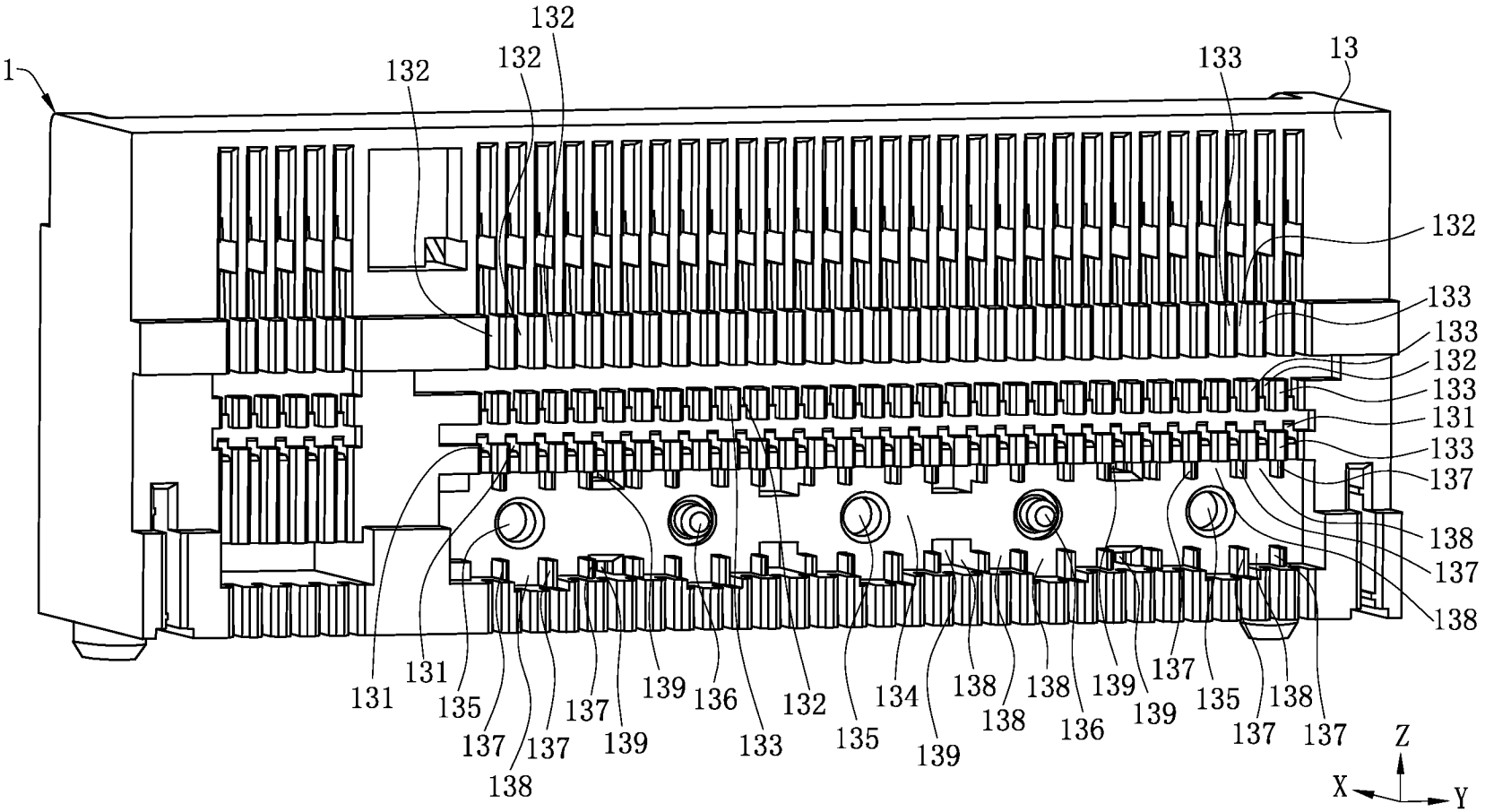
FIG. 2 is a perspective view from another viewing angle viewing from a rear side of FIG. 1, where the conductive terminals in the upper row and the grounding member are hidden.
Figure 7:
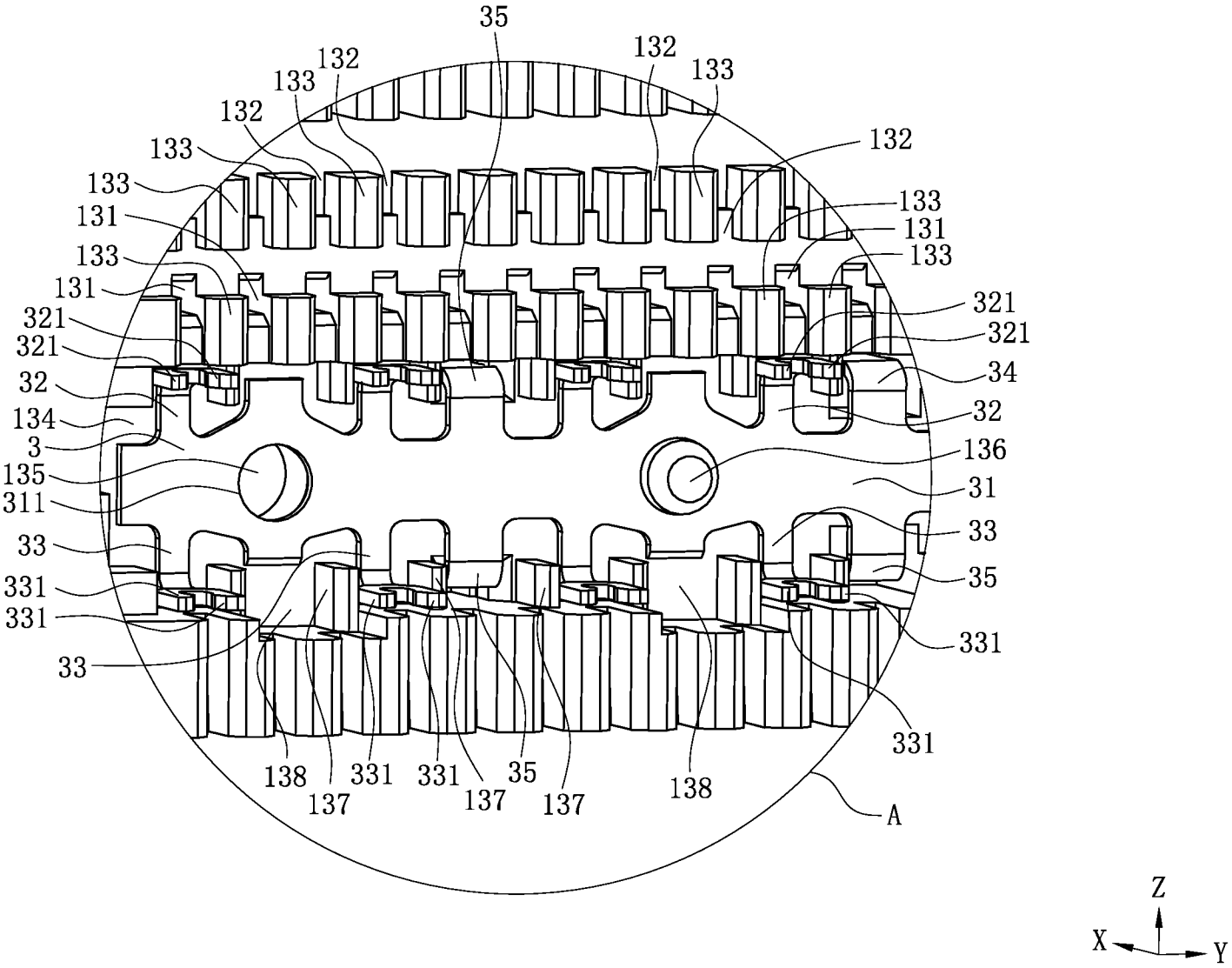
FIG. 7 is an enlarged view of a part A in FIG. 6.

As shown in FIG. 2, FIG. 7 and FIG. 12, the insulating body 1 is provided with a plurality of retaining slots 131 on the rear end surface 13 to fix the conductive terminals 2, a plurality of narrow slots 132 used to accommodate the conductive terminals 2, a plurality of partition bars 13 separating the narrow slots 132, a groove 134 located below the retaining slots 131, a plurality of mounting holes 135 formed by being concavely provided forward from the groove 134, a plurality of protruding posts 136 and a plurality of partition ribs 137 formed by extending backward from a slot wall of the groove 134, a plurality of receiving slots 138 located in the groove 134, and a plurality of fixing holes 139 formed by being concavely provided forward from the receiving slots 138. The partition ribs 137 are located in the groove 134 and provided in an upper row and a lower row. The retaining slots 131 and the groove 134 are respectively formed by being concavely provided forward from the rear end surface 13 of the insulating body 1. In the vertical direction, the groove 134 is located below the retaining slots 131. In this embodiment, at least some of the receiving slots 138 in each of the upper row and the lower row are further forward concavely provided with corresponding fixing holes 139. That is, some other receiving slots 138 are not provided with the fixing holes 139. In other embodiments, it is possible to provide a corresponding fixing hole 139 in each of the receiving slots 138.

Figure 11:
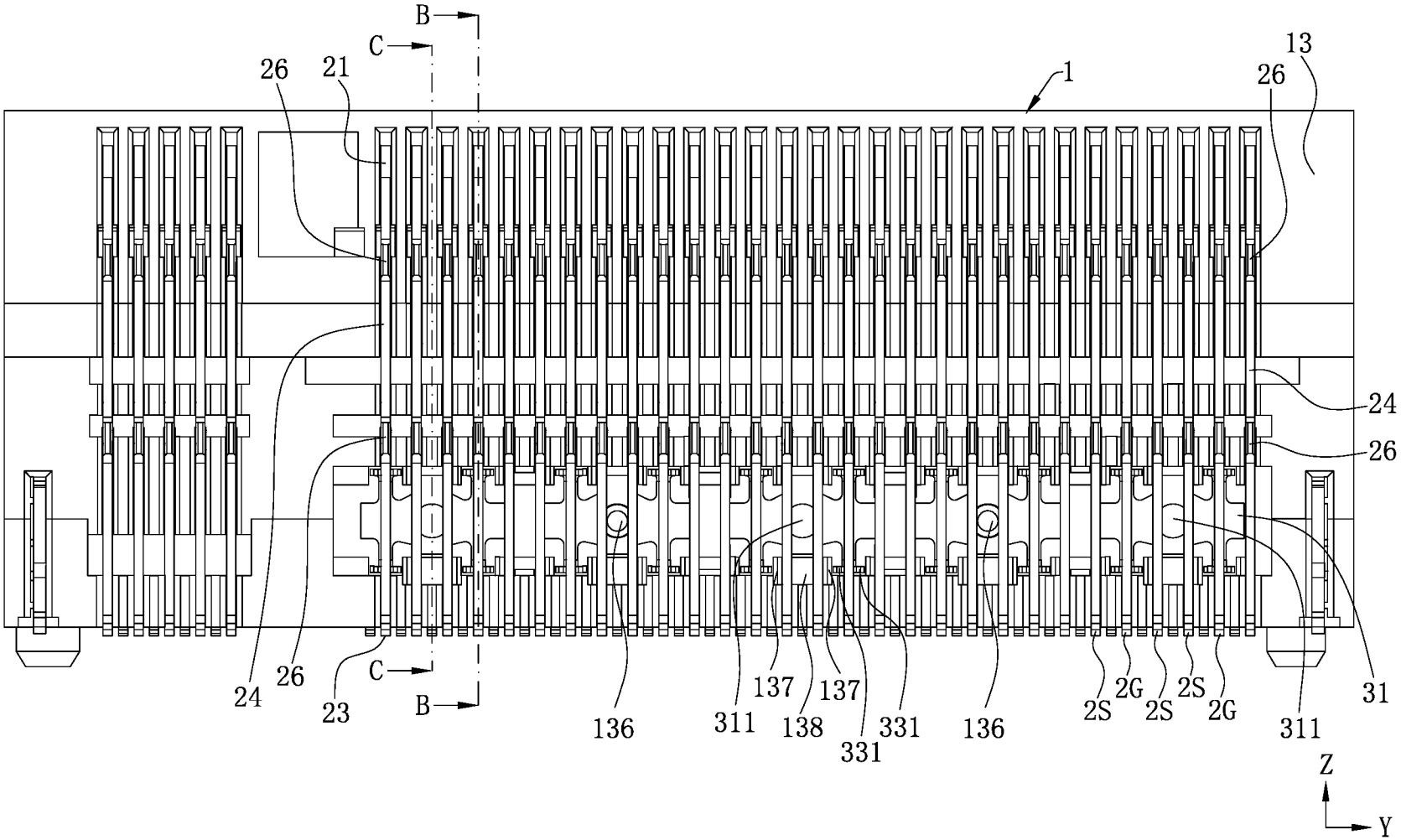
FIG. 11 is a rear view of FIG. 1.

As shown in FIG. 11, FIG. 12 and FIG. 13, the narrow slots 132 are one-to-one in upward communication with the accommodating slots 12 in the upper row. That is, each narrow slot 132 corresponds to one of the accommodating slots 12. Each narrow slot 132 substantially extends downward to a bottom surface of the insulating body 1 from the corresponding accommodating slot 12. The groove 134 is provided to be near the bottom portion of the insulating body 1, and the groove 134 is in backward communication with the narrow slots 132.

Figure 6:
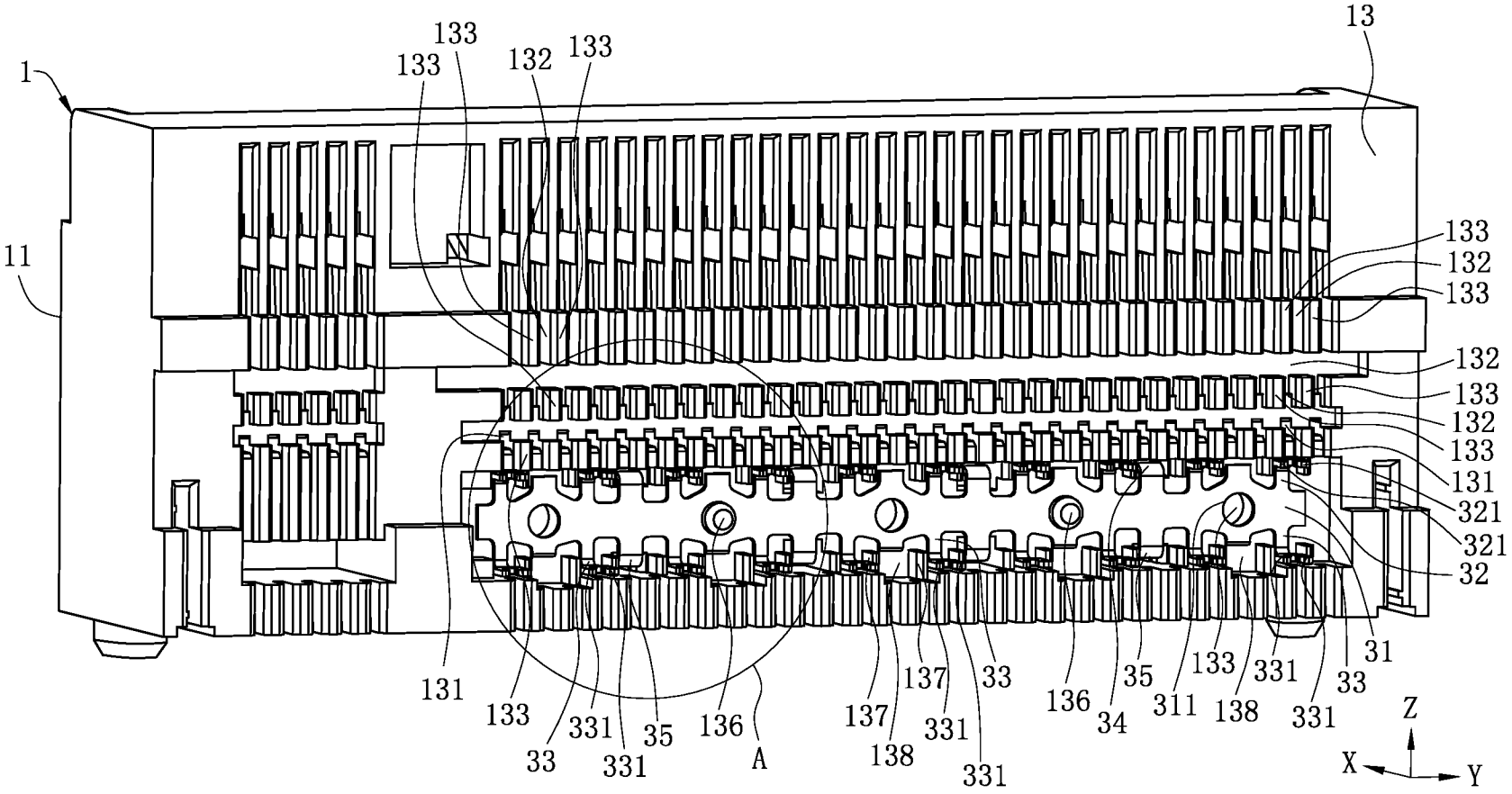
FIG. 6 is a perspective view of FIG. 5 from another viewing angle.

As shown in FIG. 6 and FIG. 7, the partition ribs 137 are provided to be concave relative to the rear end surface 13 of the insulating body 1. The partition ribs 137 in the upper row are connected upward to the slot wall of the groove 134, and the partition ribs 137 in the lower row are connected downward to the slot wall of the groove 134. The partition ribs 137 in the upper row and the lower row one-to-one correspond to each other and are provided at an interval vertically. In each row, one of the receiving slots 138 is formed between two adjacent partition ribs 137.

Figure 3:
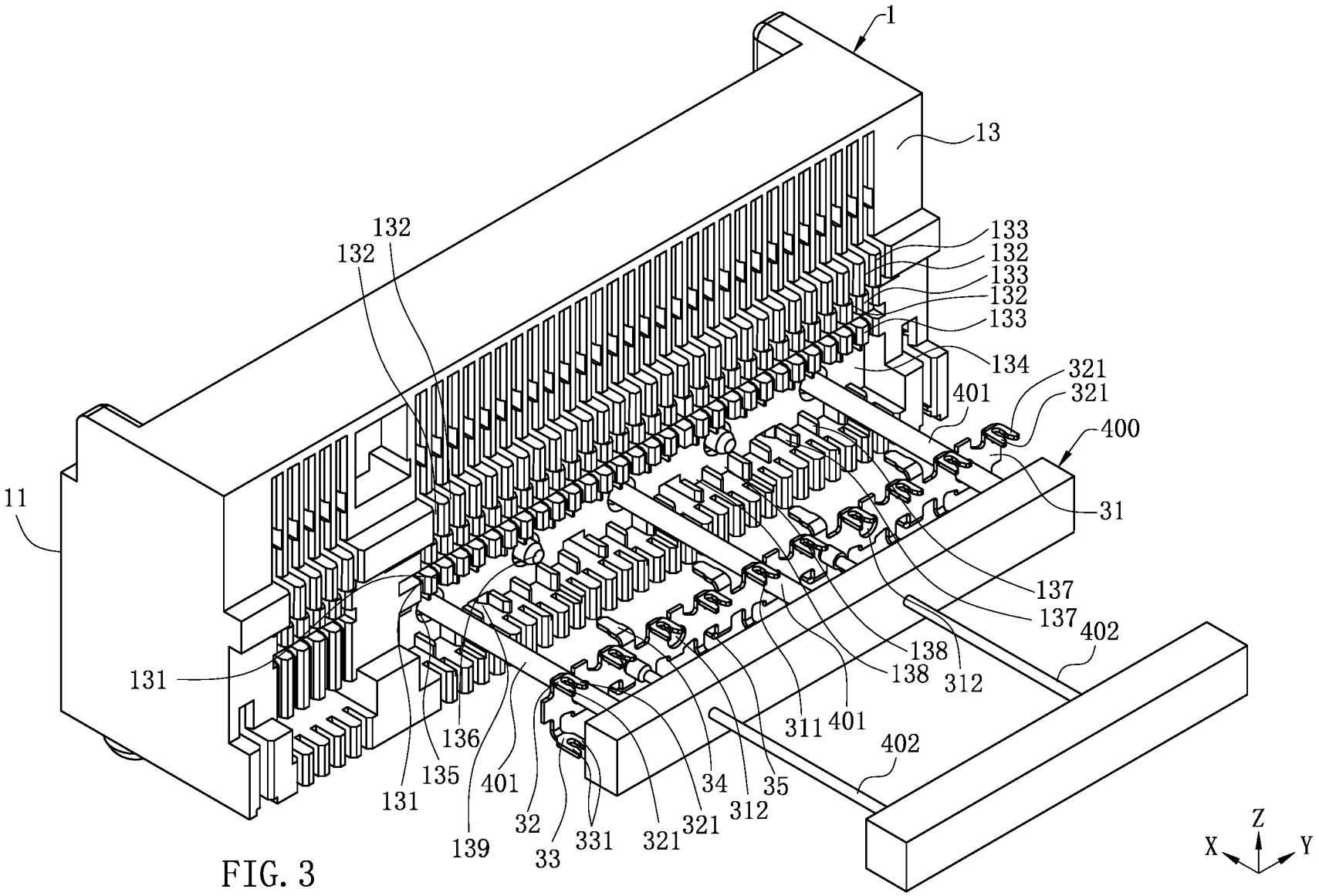
FIG. 3 is a schematic view viewing from a rear side of FIG. 1 prior to a jig pressing the grounding member into the insulating body.

As shown in FIG. 2, FIG. 3 and FIG. 13, in this embodiment, the mounting holes 135 are provided to be blind holes to position the positioning needles 401 of the jig 400. The mounting holes 135 and the protruding posts 136 are provided in a row. The mounting holes 135 and the protruding posts 136 are located at a middle position of the groove 134 in the vertical direction, and are arranged alternately along the left-right direction. In other embodiments, the rear end surface 13 of the insulating body 1 may be provided with only the mounting holes 135 in the groove 134, without providing the protruding posts 136.

Figure 8:
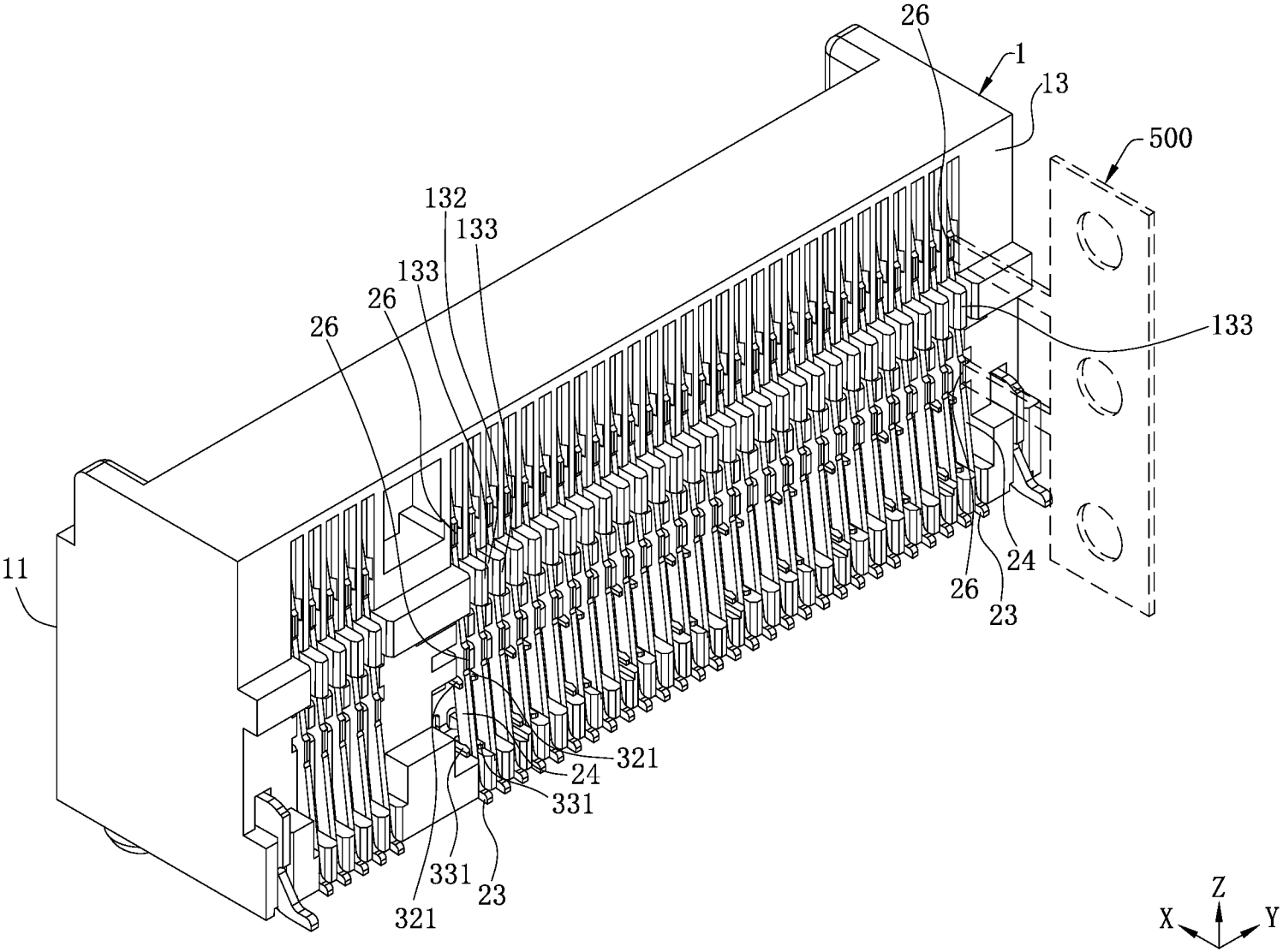
FIG. 8 is a perspective view of FIG. 5 after the conductive terminals in the upper row are assembled to the insulating body.
Figure 9:
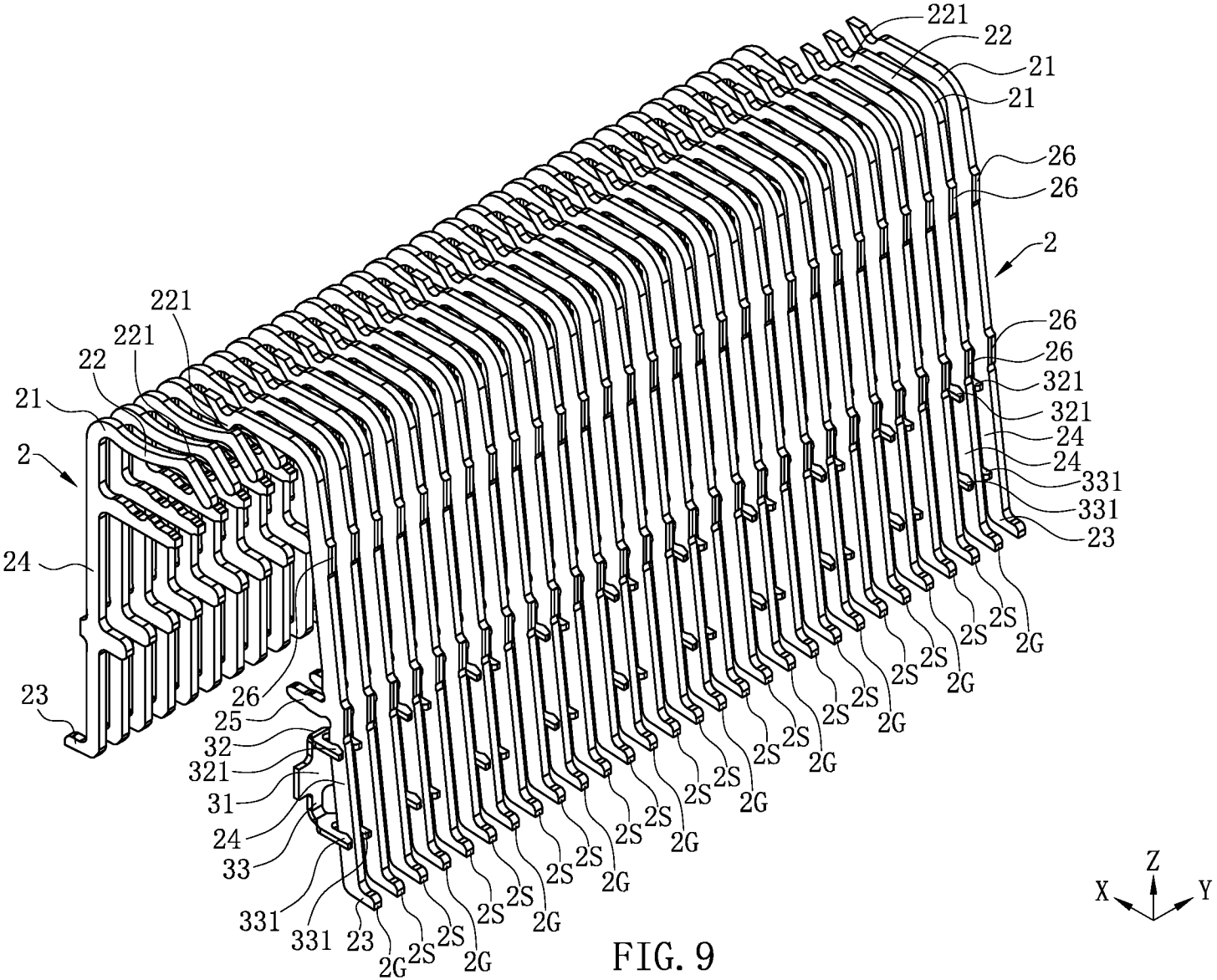
FIG. 9 is a perspective view of FIG. 8 showing only partially the conductive terminals in the upper and lower rows and the grounding member.

As shown in FIG. 1, FIG. 8 and FIG. 9, the conductive terminals 2 are formed by blanking a metal plate. The conductive terminals 2 in the two rows are correspondingly accommodated in the accommodating slots 12 in the two rows. The conductive terminals 2 in the upper row are assembled forward to the insulating body 1 from the rear end surface 13 of the insulating body 1, and the conductive terminals 2 in the lower row are assembled backward to the insulating body 1 from the front end surface 11 the insulating body 1.

As shown in FIG. 9, the conductive terminals 2 in the upper row include a plurality of ground terminals 2G and a plurality of signal terminals 2S. The signal terminals 2S include a plurality of differential terminal pairs used to transmit differential signals, and two sides of each differential terminal pair are provided with two ground terminals 2G. That is, the signal terminals 2S and the ground terminals 2G in each row are arranged in the form of G-S-S-G-S-S-G. In other embodiments, the signal terminals 2S and the ground terminals 2G in each row may be arranged in the form of G-G-S-S-G-G-S-S-G-G.

Figure 10:
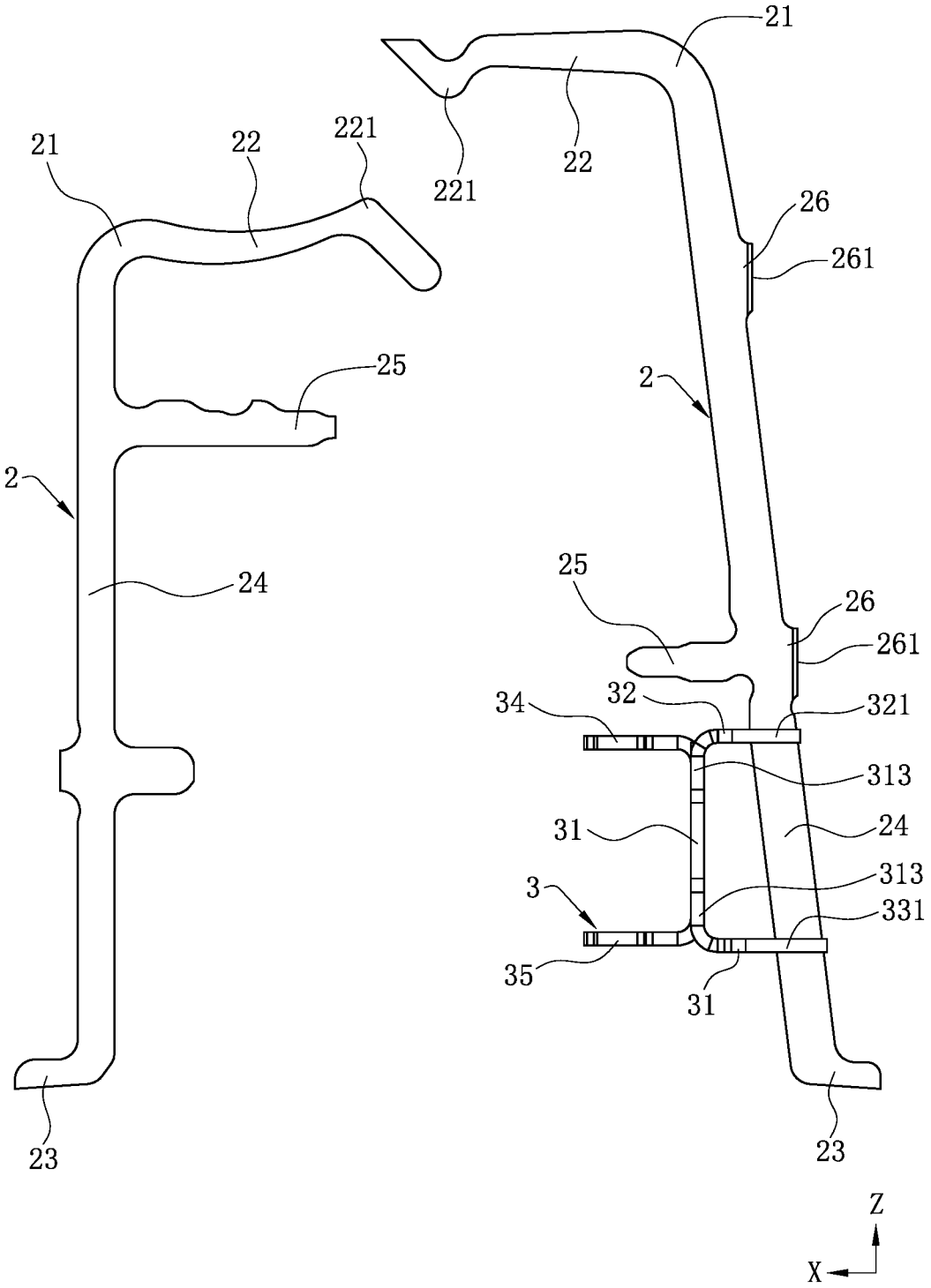
FIG. 10 is a side view of FIG. 9.

As shown in FIG. 10, FIG. 12 and FIG. 13, each conductive terminal 2 includes a connecting portion 21, an elastic arm 22 formed by extending from the connecting portion 21, a tail portion 23 exposed from the insulating body 1 and an extending portion 24 located between the connecting portion 21 and the tail portion 23. The connecting portion 21 is accommodated in the corresponding accommodating slot 12. The elastic arm 22 has a contact portion 221 protruding into the mating slot 111 to be in contact with the mating member 200 and to form an electrical connection therebetween. In this embodiment, the tail portion 23 is exposed on the bottom surface of the insulating body 1 to be electrically connected to the circuit board 300. The extending portion 24 of each conductive terminal 2 in the upper row extends obliquely downward and backward from the corresponding connecting portion 21. Such configuration shortens the transmission path of each conductive terminal 2 in the upper row from the contact portion 221 to the tail portion 23. The extending portion 24 of each conductive terminal 2 in the upper row is located behind the extending portion 24 of each conductive terminal 2 in the lower row. The extending portion 24 of each conductive terminal 2 in the lower row is vertically provided.

As shown in FIG. 8, FIG. 9 and FIG. 10, the extending portion 24 of each conductive terminal 2 is provided with a fixing portion 25 and at least one strip connecting portion 26. The fixing portion 25 is retained by the insulating body 1. The fixing portion 25 of each conductive terminal 2 in the upper row is formed by extending forward from a front side edge of the extending portion 24, and the fixing portion 25 of each conductive terminal 2 in the upper row is retained in a corresponding one of the retaining slots 131. In this embodiment, a length of the extending portion 24 located between the connecting portion 21 and the fixing portion 25 is greater than a length of the extending portion 24 located between the fixing portion 25 and the tail portion 23. Each conductive terminal 2 in the upper row is provided with two strip connecting portions 26 formed at a rear side edge of the extending portion 24. The two strip connecting portions 26 are connected to a same strip 500, and one of the strip connecting portions 26 and the fixing portion 25 are provided to be back on each other. Each strip connecting portion 26 of each conductive terminal 2 in the upper row forms a vertical breaking edge 261 extending straightly along the vertical direction at a side away from the corresponding extending portion 24. The vertical breaking edge 261 is formed by breaking the strip 500 and the strip connecting portion 26.

As shown in FIG. 7, FIG. 8 and FIG. 11, the extending portions 24 of the conductive terminals 2 in the upper row are one-to-one accommodated in the narrow slots 132 on the insulating body 1, and the extending portions 24 of the conductive terminals 2 are separated by the partition bars 133. The two strip connecting portions 26 of each conductive terminal 2 in the upper row are located between two adjacent partition bars 133, such that when the strip 500 is cut, the extending portion 24 of each conductive terminal 2 in the upper row does not bend.

Figure 5:
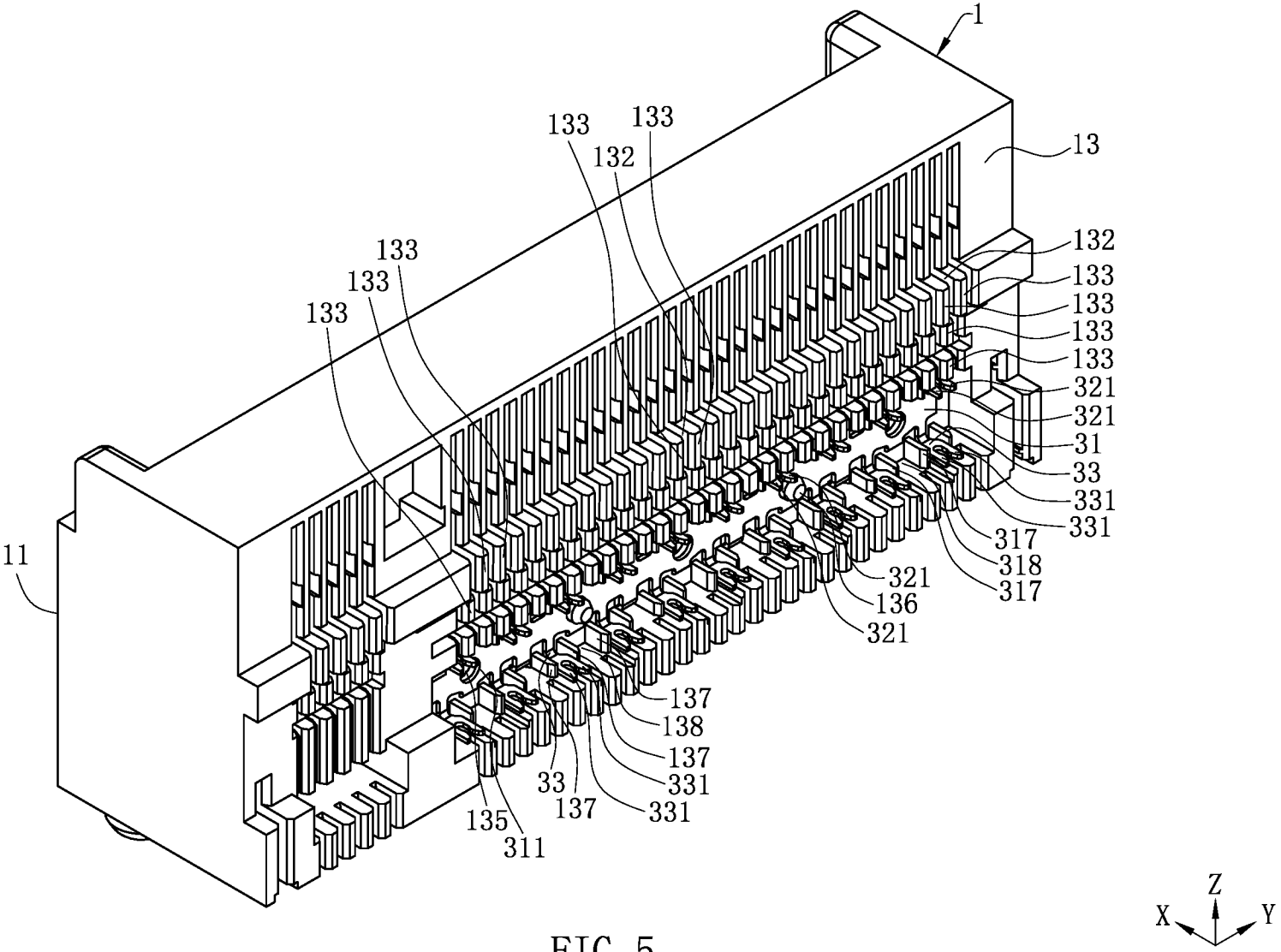
FIG. 5 is a perspective view of FIG. 4 by removing the jig and the grounding member is assembled in the insulating body.
Figure 14:
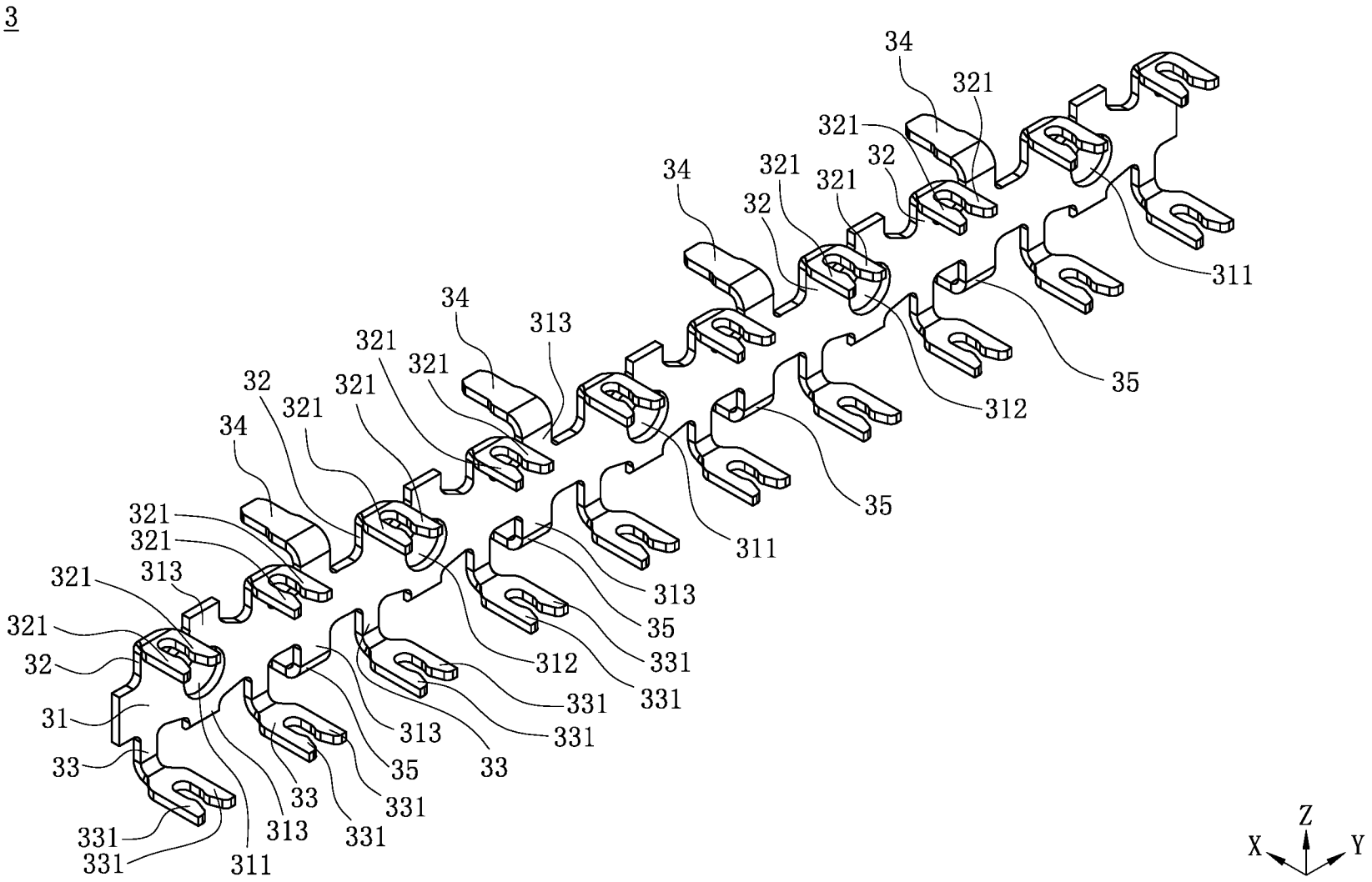
FIG. 14 is a perspective view of the grounding member in FIG. 9.

As shown in FIG. 3, FIG. 5 and FIG. 14, the grounding member 3 is retained in the insulating body 1. The grounding member 3 is formed by punching a metal plate. The grounding member 3 has a base portion 31, a plurality of upper extending arms 32 and a plurality of lower extending arms 33 formed by extending backward from the base portion 31, and at least one upper fixing portion 34 and at least one lower fixing portion 35 formed by extending forward from the base portion 31.

As shown in FIG. 5, FIG. 8 and FIG. 10, the base portion 31 is correspondingly accommodated in the groove 134 of the insulating body 1, and the base portion 31 is located between the extending portions 24 of the conductive terminals 2 in the two rows. The base portion 31 extends along the left-right direction and along the vertical direction. Thus, the base portion 31 is in a vertical flat plate shape.

As shown in FIG. 6 and FIG. 7, the base portion 31 is provided with a plurality of first through holes 311 corresponding to the mounting holes 135. The first through holes 311 are aligned forward and in communication with the corresponding mounting holes 135. The base portion 31 is provided with a plurality of second through holes 312 corresponding to the protruding posts 136. The protruding posts 136 pass through and are accommodated in the corresponding second through holes 312.

As shown in FIG. 7, FIG. 9 and FIG. 10, the upper extending arms 32 and the lower extending arms 33 are located at two opposite sides of the base portion 31, and the upper extending arms 32 are located above the lower extending arms 33. The upper extending arms 32 are one-to-one correspondingly accommodated in the receiving slots 138 in the upper row, and the lower extending arms 33 are one-to-one correspondingly accommodated in the receiving slots 138 in the lower row. The upper extending arms 32 abut the ground terminals 2G of the conductive terminals 2 in the upper row, and the lower extending arms 33 abut the ground terminals 2G of the conductive terminals 2 in the upper row. Further, one of the upper extending arms 32 and one of the lower extending arms 33 abut a same ground terminal 2G of the conductive terminals 2 in the upper row. Such configuration allows the grounding member 3 and the ground terminals 2G to form multiple point contact, such that the contact between the grounding member 3 and the ground terminals 2G is more reliable. Further, a length of each upper extending arm 32 extending in the front-rear direction is shorter than a length of each lower extending arm 33 extending in the front-rear direction, such that the upper extending arms 32 and the lower extending arms 33 match with the oblique structure of the extending portion 24 of each ground terminal 2G. Thus, the grounding member 3 does not need to be provided obliquely, allowing it to be mounted on the insulating body 1. Further, the grounding member 3 may be in reliable contact with the ground terminals 2G, thus effectively reducing the resonance. In this embodiment, each upper extending arm 32 and each lower extending arm 33 all abut the extending portion 24 of each ground terminal 2G between the fixing portion 25 and the tail portion 23. With such configuration, when the mating member 200 is inserted in the mating slot 111, the elastic deformation of the elastic arm 22 of each conductive terminal 2 in the upper row does not affect and cause the extending portion 24 between the fixing portion 25 and the tail portion 23 to move, allowing the stable contact between the grounding member 3 and the extending portion 24.

As shown in FIG. 9 and FIG. 14, each of the upper extending arms 32 is provided with a pair of upper clamping arms 321, and each of the lower extending arms 33 is provided with a pair of lower clamping arms 331. That is, each pair of the upper clamping arms 321 and each pair of the lower clamping arms 331 respectively form a U-shaped structure. The pair of upper clamping arms 321 and the pair of lower clamping arms 331 all clamp the plate surface at the left side and the right side of the corresponding extending portion 24. Such configuration ensures the upper extending arms 32 and the lower extending arms 33 to be electrically connected to the extending portion 24 stably.

As shown in FIG. 6, FIG. 7 and FIG. 14, in this embodiment, multiple upper fixing portions 34 and multiple lower fixing portions 35 are provided. Each upper fixing portion 34 is inserted into a corresponding fixing hole 139 located at an upper side of the groove 134, and the two are in an interference fit. Each lower fixing portion 35 is inserted into a corresponding fixing hole 139 located at a lower side of the groove 134, and the two are in an interference fit.

As shown in FIG. 6, FIG. 7 and FIG. 14, the base portion 31 is further provided with a plurality of connecting sheets 313 respectively located between each two adjacent upper extending arms 32 and between each two adjacent lower extending arms 33. Each connecting sheet 313 is in a vertical flat plate shaped structure. Each connecting sheet 313 located at an upper side of the base portion 31 is selectively connected to one of the upper fixing portions 34, and each connecting sheet 313 located at an lower side of the base portion 31 is selectively connected to one of the lower fixing portions 35. In this embodiment, at each of the upper and lower sides of the base portion 31, only some of the connecting sheets 313 are connected to the upper fixing portions 34 or the lower fixing portions 35. In other embodiments, each of the connecting sheets 313 is connected to the upper fixing portions 34 or the lower fixing portions 35. Such configuration of the connecting sheets 313 may be designed to select the required quantity and locations of the connecting sheets 313 based on the customer's needs.

Figure 4:
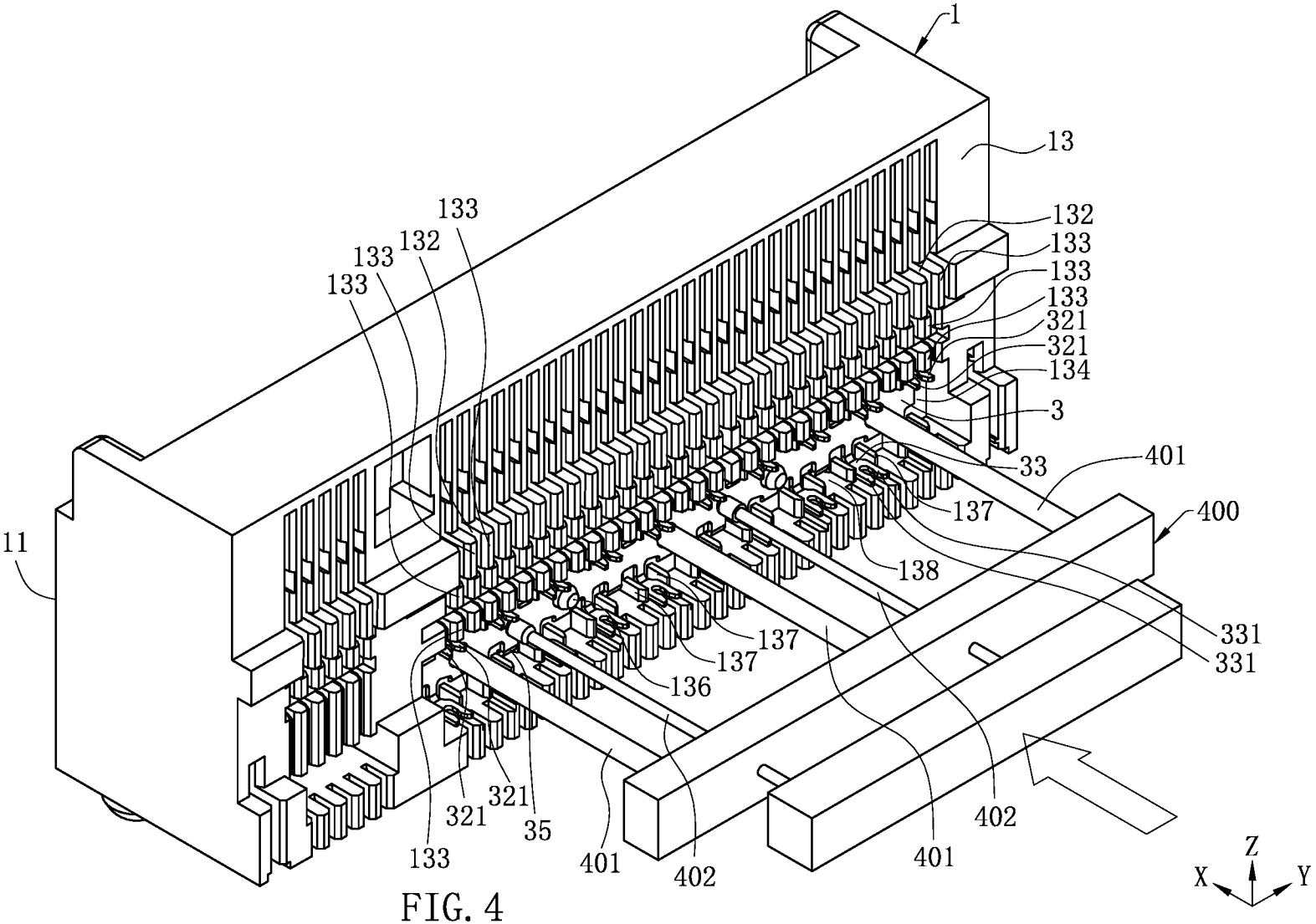
FIG. 4 is a schematic view after the jig presses the grounding member into the insulating body.

As shown in FIG. 3, FIG. 4 and FIG. 5, the mounting process of the grounding member 3 into the groove 134 of the insulating body 1 is shown. Firstly, the positioning needles 401 of the jig 400 pass through the first through holes 311 to retain the grounding member 3 onto the jig 400. Then, the positioning needles 401 of the jig 400 are inserted into the mounting holes 135 to position the positioning needles 401 of the jig 400. Finally, the pressing structure 402 on the jig 400 presses the grounding member 3, such that the grounding member 3 is accommodated in the groove 134. The protruding posts 136 pass through and are accommodated in the second through holes 312, and the upper fixing portions 34 and the lower fixing portions 35 are respectively inserted into the corresponding fixing holes 139, such that the grounding member 3 is fixed to the insulating body 1.

In sum, the electrical connector according to certain embodiments of the present invention has the following beneficial effects:

(1) Comparing to the related art, without changing the positions of the contact portion 221 and the tail portion 23, the extending portion 24 of each conductive terminal 2 in the upper row may be provided to extend obliquely downward and backward from the connecting portion 21. Such configuration shortens the transmission paths of the conductive terminals 2 in the upper row, and particularly reduces the loss in the transmission paths of the signal terminals 2S and reduces the inductance of the signal terminals 2S. The upper extending arms 32 and the lower extending arms 33 of the grounding member 3 all abut the ground terminals 2G of the conductive terminals 2 in the upper row, and the length of each upper extending arm 32 is shorter than the length of each lower extending arm 33, such that the upper extending arms 32 and the lower extending arms 33 match with the oblique structure of the extending portion 24 of each ground terminal 2G. Thus, the grounding member 3 does not need to be provided obliquely, allowing it to be mounted on the insulating body 1. Further, the grounding member 3 may facilitate multiple point contact with a same ground terminal 2G, thus ensuring the stable connection between the two, and effectively reducing the resonance.

(2) The two strip connecting portions 26 of each conductive terminal 2 in the upper row are located between the two partition bars 133, such that when the strip 500 is flick in the left-right direction, the extending portion 24 is limited from being excessively deviating in the left-right direction, thus ensuring the extending portion 24 of each conductive terminal 2 does not bend or deform subject to a force.

(3) The base portion 31 of the grounding member 3 is provided with a plurality of first through holes 311, and the insulating body 1 is provided with a plurality of mounting holes 135 in the groove 134. The first through holes 311 are aligned forward and in communication with the corresponding mounting holes 135, such that the positioning needles 401 of the jig 400 are positioned in the mounting hole 135. When the pressing structure 402 of the jig 400 presses forward the grounding member 3, the positioning needles 401 simultaneously guide the grounding member 3 to enter the groove 134, allowing the jig 400 to accurately and rapidly mount the grounding member 3 into the groove 134, and enhancing the mounting efficiency.

(4) Each upper extending arm 32 and each lower extending arm 33 all abut the extending portion 24 of each ground terminal 2G between the fixing portion 25 and the tail portion 23. With such configuration, when the mating member 200 is inserted in the mating slot 111, the elastic deformation of each conductive terminal 2 in the upper row does not affect the extending portion 24 between the fixing portion 25 and the tail portion 23, allowing the stable contact between the grounding member 3 and the extending portion 24.

(5) Each of the upper extending arms 32 is provided with a pair of upper clamping arms 321, and each of the lower extending arms 33 is provided with a pair of lower clamping arms 331. The pair of upper clamping arms 321 and the pair of lower clamping arms 331 all clamp the plate surface at the left side and the right side of the corresponding extending portion 24. Such configuration ensures the upper extending arms 32 and the lower extending arms 33 to be electrically connected to the extending portion 24 stably.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to be electrically connected to a mating member and a circuit board, the electrical connector comprising:

an insulating body, having a mating slot and a plurality of accommodating slots, wherein the mating slot is concavely formed backward from a front end surface of the insulating body to be inserted by the mating member, the accommodating slots are arranged in an upper row and a lower row and provided at an upper side and a lower side of the mating slot, respectively, and the accommodating slots are in communication with the mating slot;

a plurality of conductive terminals arranged in an upper row and a lower row, correspondingly accommodated in the accommodating slots in the upper row and the lower row, wherein the conductive terminals in the upper row comprise two ground terminals and at least one signal terminal located between the two ground terminals, each of the conductive terminals comprises a connecting portion, an elastic arm formed by extending from the connecting portion, a tail portion exposed from the insulating body and an extending portion located between the connecting portion and the tail portion, the connecting portion is accommodated in a corresponding one of the accommodating slots, the elastic arm has a contact portion protruding into the mating slot to be in contact with the mating member and to form an electrical connection therebetween, the tail portion is configured to be electrically connected to the circuit board, the extending portion of each of the conductive terminals in the upper row extends obliquely downward and backward from the connecting portion, and the extending portion of each of the conductive terminals in the upper row is located behind the extending portion of each of the conductive terminals in the lower row; and a grounding member, fixedly provided on the insulating body, wherein the grounding member has a base portion and two upper extending arms and two lower extending arms formed by extending backward from the base portion, the base portion is located between the extending portions of the conductive terminals in the upper row and the lower row, the upper extending arms are located above the lower extending arms, a length of each of the upper extending arms extending in a front-rear direction is shorter than a length of each of the lower extending arms extending in the front-rear direction, the two upper extending arms abut the two ground terminals of the conductive terminals in the upper row, the two lower extending arms abut the two ground terminals of the conductive terminals in the upper row, and one of the two upper extending arms and one of the two lower extending arms abut a same ground terminal of the two ground terminals of the conductive terminals in the upper row.

2. The electrical connector according to claim 1, wherein each of the conductive terminals in the upper row has a fixing portion formed by extending forward from a front side edge of the extending portion, the insulating body is provided with a plurality of retaining slots, each of the retaining slots corresponds to the fixing portion of each of the conductive terminals in the upper row, each of the retaining slots is formed by being concavely provided forward on a rear end surface of the insulating body, the fixing portion of each of the conductive terminals in the upper row is fixed to a corresponding one of the retaining slots, and each of the upper extending arms and each of the lower extending arms all abut the extending portion between the fixing portion and the tail portion of the same ground terminal.

3. The electrical connector according to claim 2, wherein the rear end surface of the insulating body is provided with a plurality of narrow slots, each of the narrow slots is correspondingly in upward communication with one of the accommodating slots in the upper row and correspondingly accommodates the extending portion of one of the conductive terminals in the upper row, each of the retaining slots is in communication with one of the narrow slots in the front-rear direction, the insulating body is provided with a partition bar between each two adjacent ones of the narrow slots, each of the conductive terminals in the upper row is provided with a plurality of strip connecting portions located at a rear side of the extending portion, and one of the strip connecting portions and the fixing portion are provided to be back on each other.

4. The electrical connector according to claim 2, wherein a length of the extending portion located between the connecting portion and the fixing portion is greater than a length of the extending portion located between the fixing portion and the tail portion.

5. The electrical connector according to claim 2, wherein the insulating body is provided with a groove formed by recessing forward on the rear end surface of the insulating body, and the groove is located below the retaining slots to accommodate the base portion.

6. The electrical connector according to claim 5, wherein the groove is further formed with at least one mounting hole concavely provided forward, the base portion is provided with a first through hole corresponding to each of the at least one mounting hole, the first through hole is in forward communication with a corresponding one of the at least one mounting hole, the first through hole is provided for a jig to fix the grounding member, such that the grounding member is fixed to the insulating body, and the mounting hole is reserved for the jig.

7. The electrical connector according to claim 6, wherein the insulating body has at least one protruding post formed by extending backward from a slot wall of the groove, the base portion is provided with a second through hole corresponding to each of the at least one protruding post, and the protruding post passes backward through and is accommodated by the corresponding second through hole to position the grounding member.

8. The electrical connector according to claim 1, wherein the insulating body is provided with a groove formed by recessing forward on a rear end surface of the insulating body, the grounding member is accommodated in the groove, the insulating body is provided with a plurality of partition ribs in the groove and provided in an upper row and a lower row, a receiving slot is formed between two adjacent ones of the partition ribs in each of the upper row and the lower row, each of the upper extending arms is correspondingly accommodated in the receiving slot located in the upper row, and each of the lower extending arms is correspondingly accommodated in the receiving slot located in the lower row.

9. The electrical connector according to claim 8, wherein each of at least some of the receiving slots in each of the upper row and the lower row is further forward concavely provided with a fixing hole, the grounding member has at least one upper fixing portion and at least one lower fixing portion formed by extending forward from the base portion, and the upper fixing portion and the lower fixing portion are respectively fixed to the corresponding fixing holes, such that the grounding member is fixed to the insulating body.

10. The electrical connector according to claim 1, wherein the extending portion of each of the conductive terminals in the lower row is vertically provided.

11. The electrical connector according to claim 1, wherein the conductive terminals in the upper row are formed by blanking a metal plate, each of the upper extending arms is provided with a pair of upper clamping arms, each of the lower extending arms is provided with a pair of lower clamping arms, the pair of upper clamping arms and the pair of lower clamping arms respectively clamp a left side and a right side of the corresponding extending portion.

12. The electrical connector according to claim 1, wherein each of the conductive terminals in the upper row further comprises at least one strip connecting portion provided at a rear side of the extending portion, the strip connecting portion is configured to be connected to a strip, and the strip connecting portion forms a vertical breaking edge extending straightly along a vertical direction at a side away from the corresponding extending portion.

13. The electrical connector according to claim 1, wherein the grounding member has at least one upper fixing portion and at least one lower fixing portion formed by extending forward from the base portion, the upper fixing portion and the lower fixing portion are respectively fixed to the insulating body, the conductive terminals in the upper row comprise more than two ground terminals and a plurality of signal terminals, two of the signal terminals are provided between each two adjacent ones of the ground terminals, the grounding member is provided with more than two upper extending arms and more than two lower extending arms, the base portion is further provided with a plurality of connecting sheets respectively located between each two adjacent ones of the upper extending arms and between each two adjacent ones of the lower extending arms, each of the connecting sheets is in a vertical flat plate shaped structure, each of the connecting sheets located at an upper side of the base portion is selectively connected to one of the upper fixing portions, and each of the connecting sheets located at an lower side of the base portion is selectively connected to one of the lower fixing portions.

* * * * *